US007392641B2

(12) United States Patent
Abate

(10) Patent No.: US 7,392,641 B2
(45) Date of Patent: Jul. 1, 2008

(54) DEVICE FOR FORMING A VACUUM IN CONTAINERS WITH SEPARABLE AND WASHABLE LIQUID RECOVERY TRAY

(75) Inventor: Riccardo Abate, San Martino Della Battaglia (IT)

(73) Assignee: Flaem Nuova S.p.A., Brescia (IT)

( * ) Notice: Subject to any disclaimer, the term of this patent is extended or adjusted under 35 U.S.C. 154(b) by 77 days.

(21) Appl. No.: 10/571,227

(22) PCT Filed: Nov. 12, 2004

(86) PCT No.: PCT/IT2004/000622

§ 371 (c)(1),
(2), (4) Date: Mar. 6, 2006

(87) PCT Pub. No.: WO2005/123512

PCT Pub. Date: Dec. 29, 2005

(65) Prior Publication Data

US 2007/0027012 A1 Feb. 1, 2007

(30) Foreign Application Priority Data

Jun. 16, 2004 (IT) ..... BS20040028 U

(51) Int. Cl.
*B65B 31/02* (2006.01)

(52) U.S. Cl. ..... 53/512; 53/374.9; 53/390

(58) Field of Classification Search ..... 53/512
See application file for complete search history.

(56) References Cited

U.S. PATENT DOCUMENTS 4,860,523 A * 8/1989 Teteishi et al. ..... 53/512
4,941,310 A * 7/1990 Kristen ..... 53/512
5,638,664 A * 6/1997 Levsen et al. ..... 53/512
5,784,862 A * 7/1998 Germano ..... 53/512
5,893,822 A * 4/1999 Deni et al. ..... 53/512
6,256,968 B1 * 7/2001 Kristen ..... 53/512
7,003,928 B2 * 2/2006 Patterson et al. ..... 53/405
7,076,929 B2 * 7/2006 Patterson et al. ..... 53/405
2004/0065051 A1 4/2004 Patterson et al.
2005/0050855 A1 * 3/2005 Baptista ..... 53/434
2006/0053748 A1 * 3/2006 Ahn et al. ..... 53/434

FOREIGN PATENT DOCUMENTS

| | | |
|---|---|---|
| EP | 0 723 915 | 7/1996 |
| JP | 2002-308215 | 10/2002 |
| WO | WO 02/64429 | 8/2002 |
| WO | WO 2004/048203 | 6/2004 |

* cited by examiner

*Primary Examiner*—Stephen F Gerrity
(74) *Attorney, Agent, or Firm*—McGlew & Tuttle, P.C.

(57) ABSTRACT

The invention concerns a device for creating a vacuum in, and sealing containers for the preservation of vacuum packed products. It includes a plate or tray base (11, 41) forming at least a part of a suction chamber and having at the rear a couple of constraint means, and a top body (12, 42) which forms the remaining part of said suction chamber and which houses an aspirator group and holds a sealing bar and means for controlling the functions of the device. The body is movable above the plate or tray base between a raised open position and a lowered closed position and removable by means of a free and independent manipulation of the plate or tray.

12 Claims, 5 Drawing Sheets

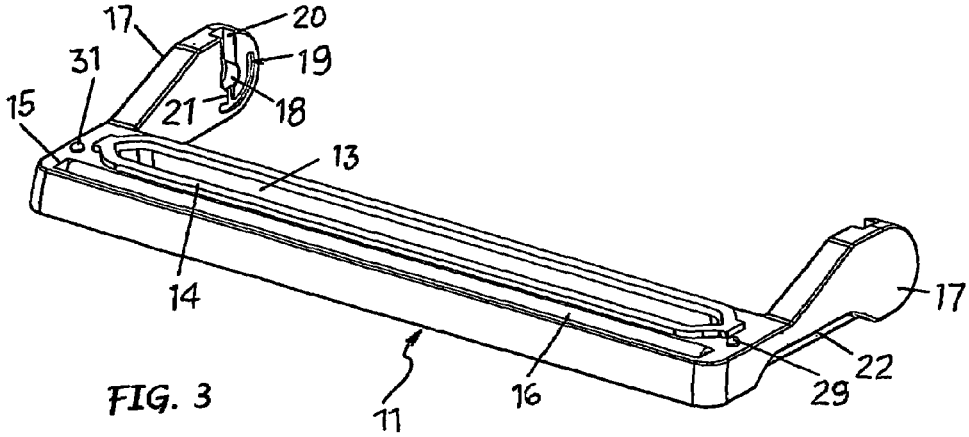
FIG. 3
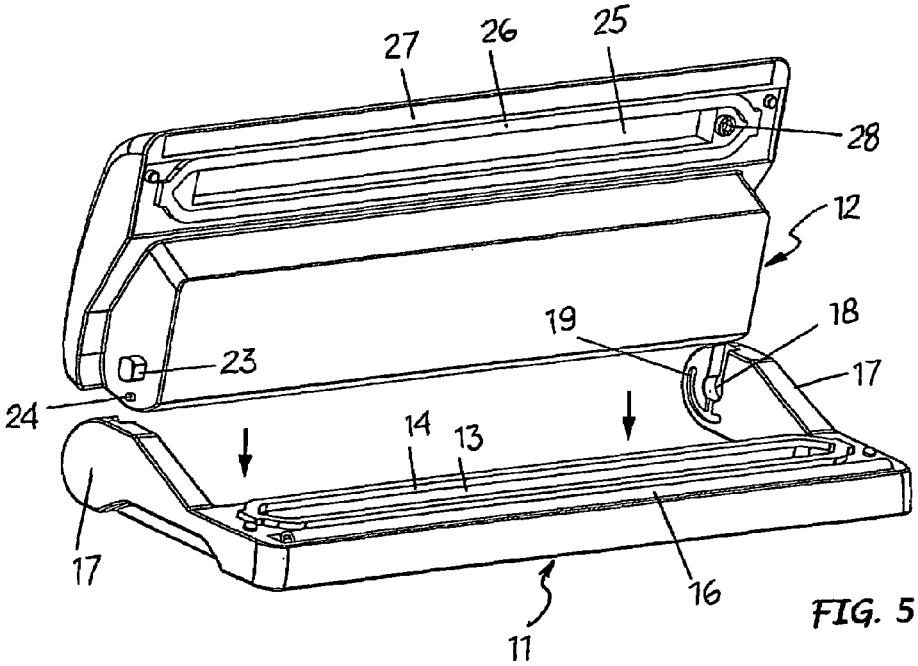
FIG. 5
FIG. 1
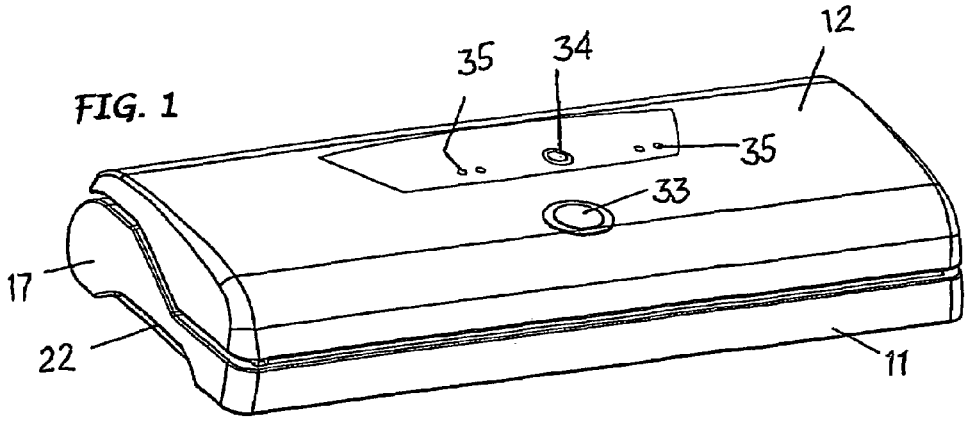

FIG. 9
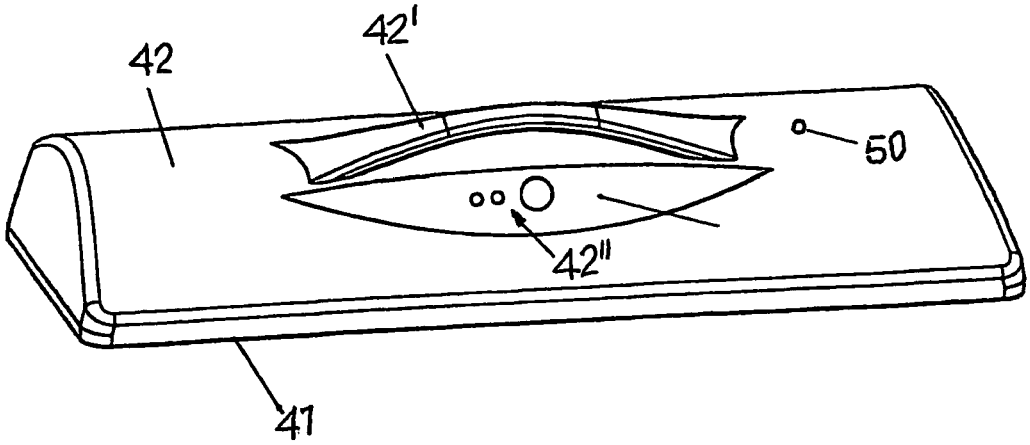
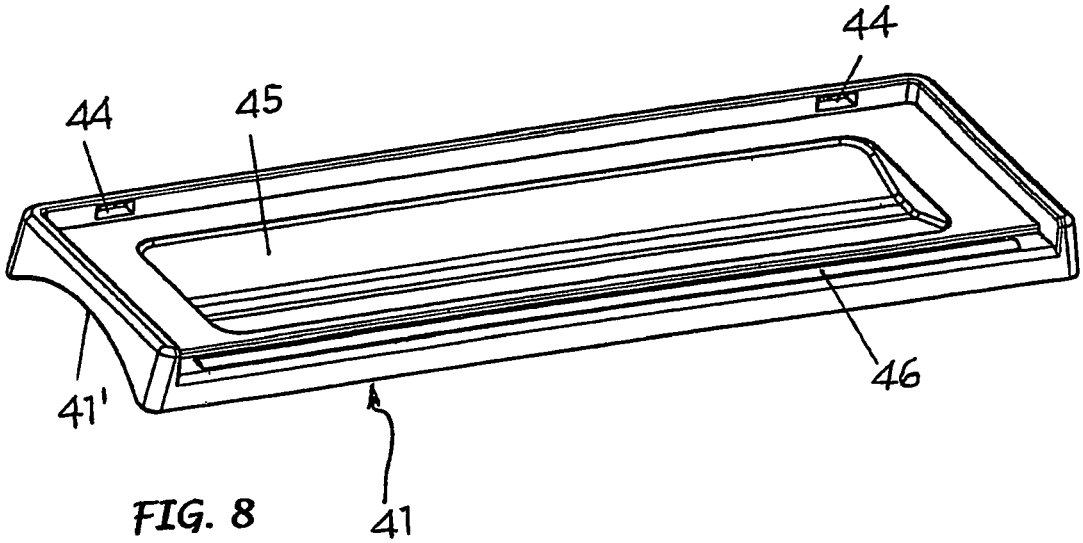
FIG. 8
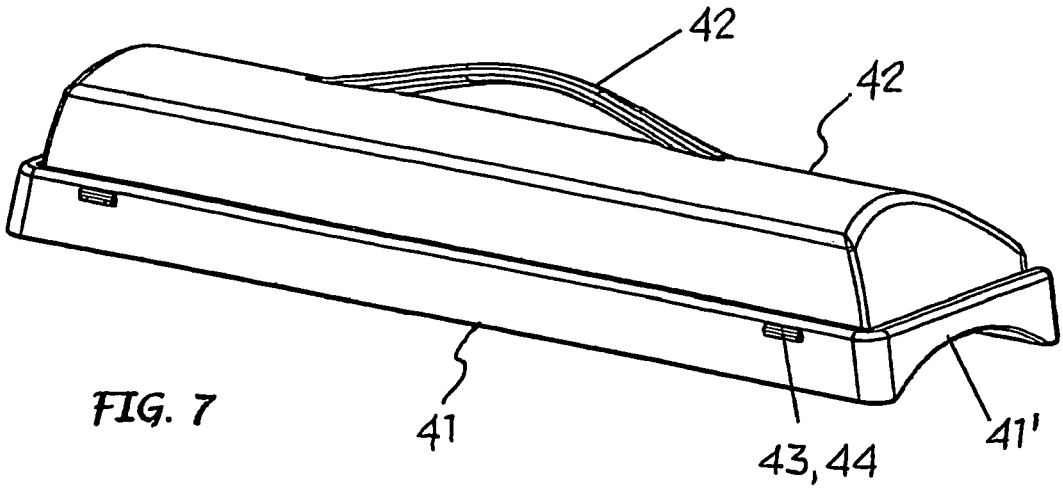
FIG. 7

DEVICE FOR FORMING A VACUUM IN CONTAINERS WITH SEPARABLE AND WASHABLE LIQUID RECOVERY TRAY

FIELD OF THE INVENTION

This invention concerns devices for forming a vacuum in flexible containers such as bags or rigid containers such as jars or canisters, for the preservation of vacuum packed products and to seal the containers when they are the flexible type.

STATE OF THE ART

Devices to form and maintain the vacuum in containers are already well known and such devices are made up principally of: a body; a cover or lever moving with respect to the body between an open and a closed position; a suction chamber between the body and the cover to receive the mouth of the bag; an aspirator device, pneumatically connected to said chamber to extract the air from the bag to form a vacuum when the cover or lever is in the closed position; and a hot sealing bar to close the mouth of the bag to retain the vacuum.

The body in these devices, usually also forms the supporting base and houses the aspirator group, made up of a vacuum pump driven by a motor normally fed electrically by a current transformer and an electronic control board. The cover or lever is hinged to the body, it moves above the letter, it can be equipped with means for constraining it to the body on closing and has a front section which contains the controls and viewing means of the vacuum, a discharge valve and possibly a coupling in communication with the aspirator group to connect an aspirator tube to, to form the vacuum in the rigid containers equipped with an appropriate cover.

Within the sphere of said equipment, the suction chamber is furthermore envisaged in the body base and the sealing bar is positioned along one side, the front one, of said chamber. The chamber is sealed by having the mouth of the bag held when the cover or lever is lowered onto the body, and also carries out the function of collecting any liquid substance exiting or sucked out of the container. The suction chamber can be formed by a tray which is some cases is separable from the body or which can be extracted like a drawer to enable it to be washed.

For the formation of a vacuum in flexible containers for the preservation of vacuum packed products there also exists a device with a body housing the means of suction and when operating simply rests on a plane without being fixed to it, and another device made up of two plates, which may be hinged together or free, and which rest one on top of the other with the interposition of a ring seal, which forms a suction chamber made to receive the mouth of the container, but which is connected to an external aspirator, that is to say external to and not connected to the device.

OBJECTS AND SUMMARY OF THE INVENTION

The above being given, the aim of this invention is to construct a device for the use stated above using an original device and combination of its components so as to facilitate the removal of the part into which liquid substances can drip and collect and which can be washed without the body housing the aspirator group and electric components being involved.

This objective is reached in a device for forming a vacuum in, and sealing, containers for the preservation of vacuum packed products which includes a plate or tray base forming at least one part of a suction chamber and supplied with a couple of means of attachment, and a body which forms the rest of said suction chamber and which houses an aspirator group and contains a sealing bar and controls for the functions of the device, said body being separately associated with the means of constraint of the plate or tray base, moving above the latter between an open and a closed position of the suction chamber and which can be removed from the plate or tray, by means of a manipulation not involving the latter.

In other words, what was once the cover positioned and moving above the body of the more traditional devices, in the device according to this invention becomes a plate or tray base forming at least a part of the suction chamber, whereas the body which in the more traditional devices formed the base, in the device proposed herein, acts primarily as a cover and above all can be separated from the plate or tray base so as to release the latter for washing purposes.

BRIEF DESCRIPTION OF THE DRAWINGS

More details of the invention will however become more apparent in the continuation of this description made in reference to the enclosed indicative and not limiting drawings, in which:

FIG. 1 shows a view in perspective of a device according to a method of construction in the closed position;

FIG. 3 shows a view only of the plate or tray base of the device in FIGS. 1 and 2;

FIG. 5 shows a view in perspective of the body or tray base and the top of the body in a connecting/disconnecting phase.

FIGS. 6 and 7 show a device according to another way of construction, in the closed position, seen from two different angles;

FIG. 8 shows a view in perspective of only the plate or tray base of the device in FIGS. 6 and 7;

FIGS. 9 and 10 show the views in perspective from above and below of only the top body of the device in FIGS. 6 and 7, and FIGS. 11, 12 and 13 show different ways of construction and collocation of a coupling for a vacuum formation tube in rigid containers such as jars and canisters.

DETAILED DESCRIPTION OF DRAWINGS

Figure 4:
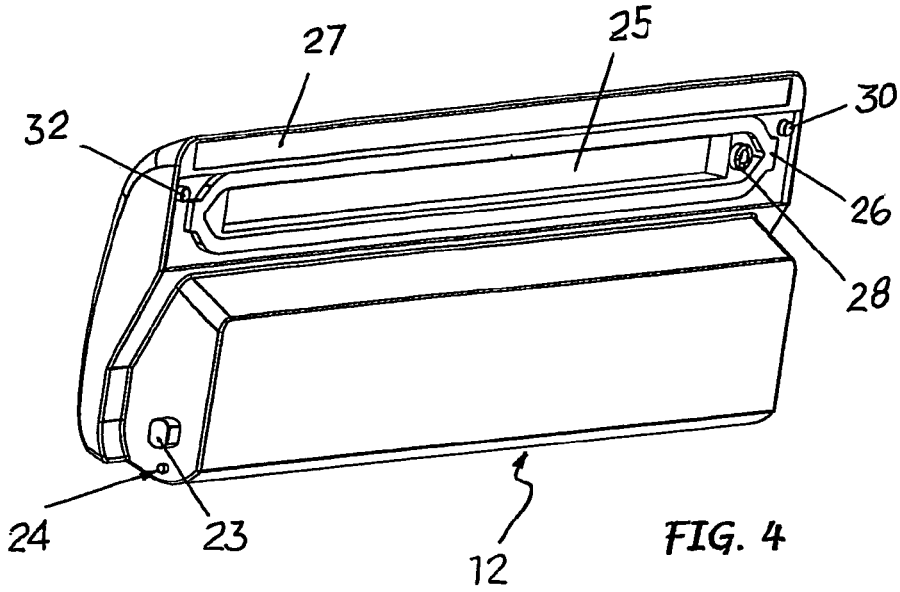
FIG. 4 shows a view of the top of the body only of the device in FIGS. 1 and 2.
Figure 2:
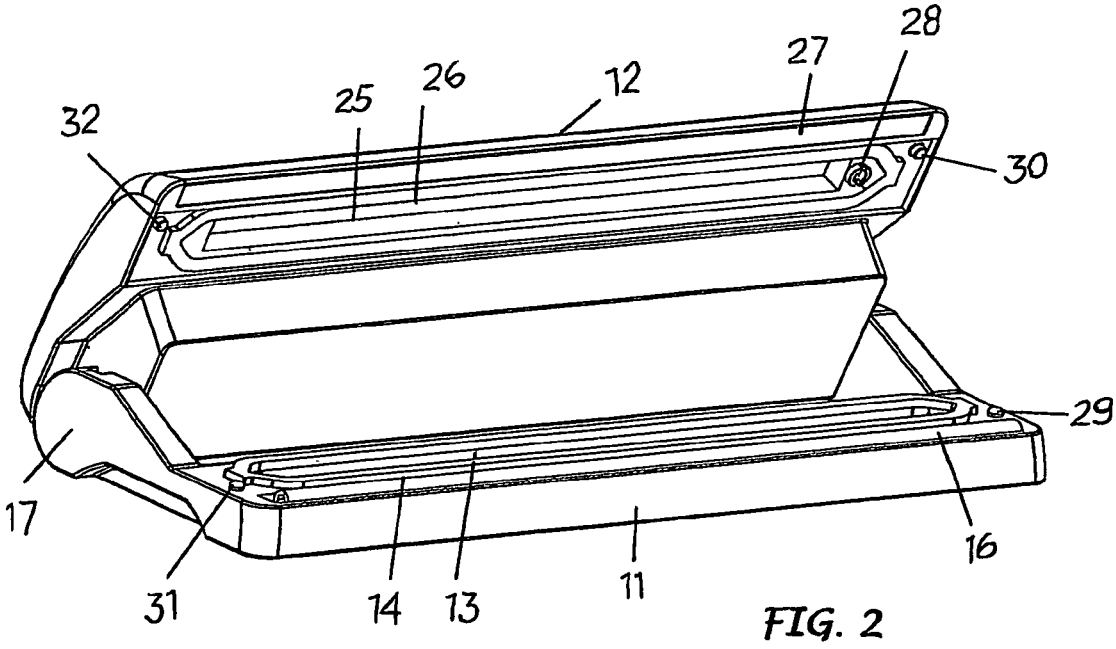
FIG. 2 shows a view in perspective of the device in FIG. 1, but open.
Figure 6:
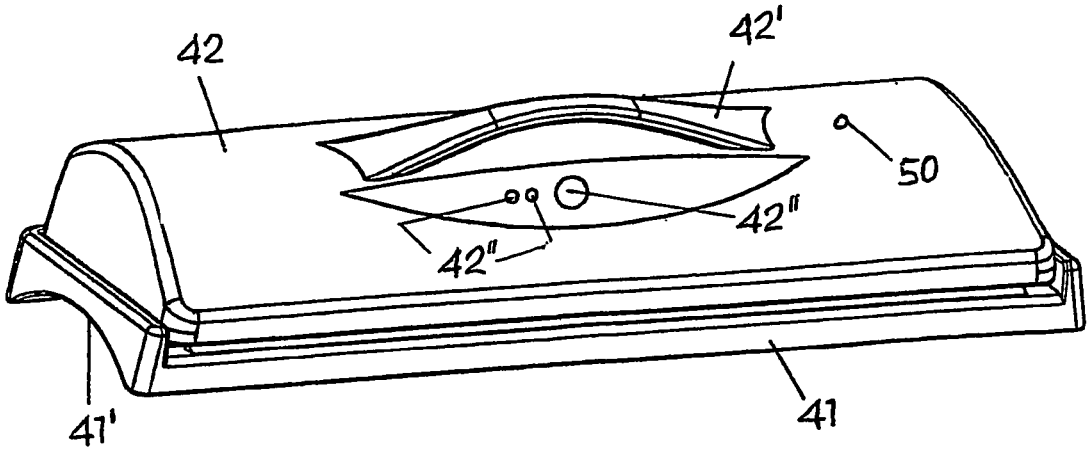
Figure 10:
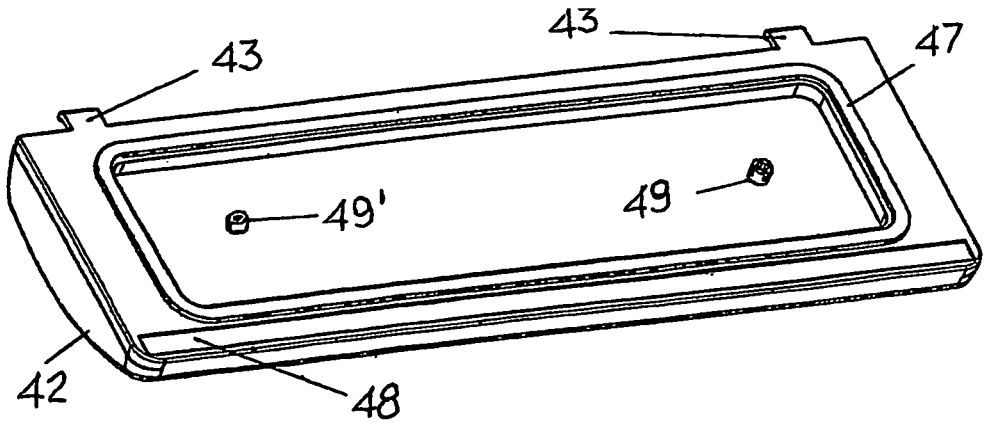

As shown in the method of construction in FIGS. 1-5, the device includes a plate or tray base 11 and a top body 12.

On its top side, the plate or tray 11 has an indentation which forms a basin 13 bordered by a seal 14 and, parallel to the front side of said basin, a groove 15 housing a seal around its border 16.

At the rear, the plate or tray 11 is equipped with a pair of lugs 17 each having, on the internal side facing towards the opposite lug, a saddle shaped housing 18 and, concentrically to the latter, an arch shaped slot 19. The saddle shaped housing 18 can be accessed from top to bottom through a slot 20, whereas the arch shaped slot 19 has a radial access slot 21 which starts from the saddle shaped housing 18. Two recesses 22 acting as grips can be cut into the opposite side ends of the plate or tray 11.

The top body 12 is made up of two shells one lower and one top 12', 12", joined together. It has two pins 23, on the opposite sides, used to couple together, by means of the slots 20, with the saddle shaped housings of the lugs of the plate or tray base 11 so that the body is able to turn between a lowered closed position on the plate or tray and a raised open position.

In addition, on the opposite sides of the body, parallel to each pin 23 is a stop rung 24 which, by means of the slot 21, fits into the arch shaped slot 19 of the respective lug 17, enabling the body 12 to turn and at the same time a constraint between the body and plate or tray base 11.

On the bottom face of said body 12 is an indent 25 bordered by a seal 26 and parallel to the front side of said indent is assembled a sealing bar 27.

The top body 12 is also shaped to house the usual, although not represented, operating components of the device, such as a motor driven vacuum pump, the electric feed and control components of the functions of the device, including the suction ducts starting from a suction outlet 28 facing the indent 25 of said body.

When the body 12 is lowered in the closed position on the plate or tray 11, the indent 25 of the body 12 matches the hollow of the basin 13 of the plate or tray 11 forming together with the help of the respective seals 14 and 26, a suction chamber, whereas the sealing bar 27 matches the border seal 16 of the plate or tray base 11.

The device is used as is usual, placing the mouth of the bag on a level with the suction chamber between plate and tray base and top body and starting the suction and sealing operations once the top body is closed onto the plate or tray base.

To manage starting of the device for example, a rung 29 can be cut in the top face of the plate or tray base 11 to interact with a pushbutton 30 positioned on board the top body 12 and set to enable or disable the start of the cycle of the device and a second pin 31 set to interact with a second pushbutton 30, also on board the top body and envisaged to enable the sealing function and to disable it for safety reasons where regulations so require.

A discharge valve 33 can be positioned on the top body and a front board with at least one pushbutton 34 to manually control the device and warning lights 35 to indicate some of the functions of the device. With the machine positioned as in FIG. 2, it is also possible to create a vacuum in rigid containers, by connecting them to the inlet 28 by means of a tube and pressing the control pushbutton 30.

In the same way, in the simplified construction example shown in FIGS. 6-10, the device according to the invention includes a plate or tray base 41 with end recesses 41' to facilitate gripping and a top body 42 which houses the usual operating components of the device and which is equipped with a handle 42' and a front board with the controls 42".

In this case, the top body 42 has a pair of rear lugs 43 which fit into slots 44 cut in the rear side of the plate or tray base to form a separable connection of the two components 41, 42. Furthermore, on its top face, the plate or tray base 41 has a basin 45 without a border seal and a weather seal 46 parallel with the basin.

On the other hand, the top body 42 has on its bottom side a ring seal 47 and a sealing bar 48. The ring seal 47 will rest against the top side of the plate or tray base around the basin 45 forming a suction chamber leading into which is a first suction outlet 49 equipped with an interchangeable filter connected to the vacuum pump of the body itself and a second vacuum measurer outlet 49', equipped with a filter and connected to the management circuit of the various phases of the operating cycle of the device.

In both the illustrated constructions, the top body 12, 42 is however separable from the plate or tray base 11, 41, so the latter can be easily manipulated and washed according to needs without interference with the part of the body containing the operating and electric components.

In addition, on the body 12 or 42 a coupling 50 can be provided to connect a tube to create a vacuum in containers other than bags, such as for example jars and canisters.

Figure 11:
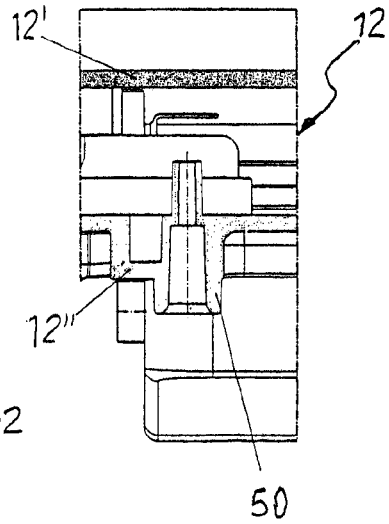

In one method of construction as shown in FIG. 11, the coupling 50 is positioned in the bottom shell 12" of the body 12 (or 42) and can be used when said body is raised in the open position above the plate or tray base 11 (or 41) and even without the presence of the latter.

Figure 12:
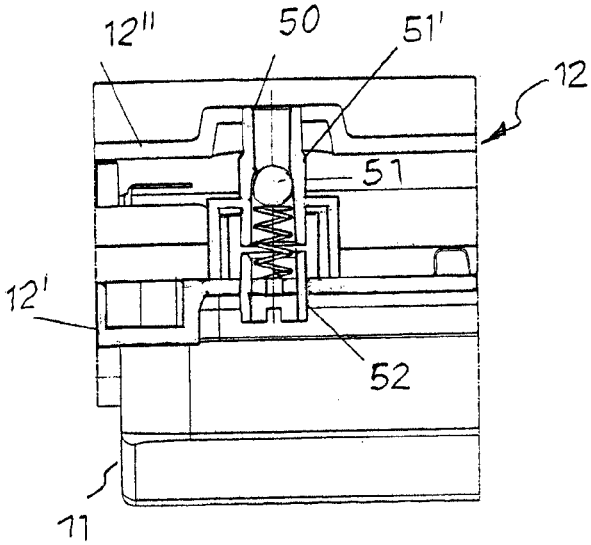

In another construction method as shown in FIG. 12, the coupling 50 is positioned in the top body 12 (or 42) and can be used when this body is closed on the plate or tray base 11 (or 41). The coupling is in communication with the basin 13 (or 45) formed by said plate or tray base and containing a ball stop 51 operated by a spring 52 and set to close the coupling outlet, with possible interposition of a seal 51', for normal operation of the device and when the tube is not connected to it to form a vacuum in a jar or canister.

Figure 13:
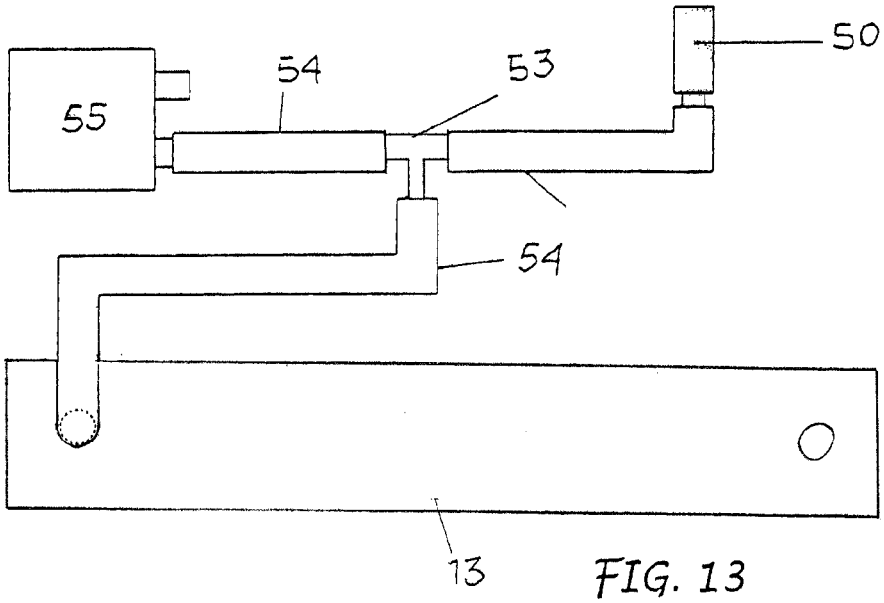

In a further construction method as shown in FIG. 13, the coupling 50 can be positioned in any point of the device and is connected by means of a T joint 53 to a tube 54 which has one end connected to the basin 13 (or 45) and the other to the suction pump 55 placed in the top body of the device. Also in this case the coupling can be fitted with a ball stop for closing the coupling outlet when no tube is connected to it to form a vacuum in a jar or canister.

The invention claimed is:

1. A device for forming a vacuum in, and to seal, containers for the preservation of vacuum packed products, the device comprising:

a vacuum pump;

a plate or tray base forming at least a part of a suction chamber, said plate or tray base having a pair of connecting elements;

a top body, said top body housing said vacuum pump, said top body forming another part of said suction chamber, said top body including a sealing bar and a control means for controlling said vacuum pump, said top body being detachably pivotably connected to said plate or tray base such that said top body moves from a raised open position to a lowered closed position, said top body and said plate or tray base forming said suction chamber when said top body is in said lowered closed position, said suction chamber being connected to said vacuum pump, said top body with said vacuum pump being removable from said plate or tray such that said top body is freely and independently movable, said connection elements comprising a pair of lugs protruding from a rear part of the plate or tray base, each lug having a saddle shaped housing accessible from the top towards the bottom through a split and, concentrically to the saddle shaped housing, an arch shaped slot with a radial access slot which extends from the saddle shaped housing, said top body having two pins on opposite sides designed to lock with said saddle shaped housings of the lugs of the plate or tray base while being removable from said saddle shaped housing and a stop pin housed through the opening in said slot enabling the body to turn and at the same time a constraint between the body and plate or tray base.

2. A device in compliance with claim 1, wherein said plate or tray base has a recess in the top surface, which forms a basin bordered by a seal, said plate or tray base having a groove, said groove housing a profiled seal parallel to the front side of said basin, said top body having a recess on the bottom side, said recess of said top body being surrounded by a seal, said sealing bar being parallel to the front end of said recesses, said basin and recess matching to form the suction chamber when said top body is in said lowered closed position, said seals sealing said suction chamber.

3. A device according to claim 1, wherein said plate or tray base has a small basin in the top surface, said basin being bordered by a seal parallel to the front side of said basin, said top body having a ring seal on its lower side, said ring seal resting against the top surface of the plate or tray base around said basin to form the suction chamber when the top body is in the lowered closed position on the plate or tray base.

4. A device according to claim 1, wherein said connections elements further comprise a pair of slots in the rear part of the plate or tray base and two lugs located on the rear of the top body designed to engage with said slots in the rear part of the plate or tray base.

5. A device according to claim 1, wherein the plate or tray base has two end recesses forming grip zones.

6. A device according to claim 1, wherein the top body has a grip handle.

7. A device according to claim 1, wherein said top body has a coupling for the connection of a tube to form a vacuum in rigid containers, said coupling being connected to the vacuum pump and usable when said body is raised in the open position above the plate or tray base even if said plate or tray base is not present.

8. Device according to claim 1, wherein said top body has a coupling for the connection of a tube to form a vacuum in rigid containers, said coupling being in communication with a basin formed by said plate or tray base, said coupling having a ball stop designed to close the coupling output for normal functioning of the device, said ball stop closing the coupling output when the tube to create a vacuum in a rigid container is not connected to said coupling outlet.

9. A device according to claim 1, wherein said top body has a coupling for the connection of a tube to form a vacuum in rigid containers, said coupling being connected to a tube via a T fitting, one end of said tube being in communication with the basin and another end of said tube being placed in the top body, said coupling having a ball stop for closing the coupling outlet when no tube is connected to said coupling outlet to form a vacuum in rigid containers.

10. A device for forming a vacuum, the device comprising:

a top body, said top body having a first pin and a second pin, said top body having a first stop pin and a second stop pin, said top body defining a first recess, said top body including a sealing bar;

a plate defining a second recess, said plate having a first connection piece and a second connection piece, said first connection piece being disposed opposite said second connection piece, said first connection piece defining a first housing and a first slot, said second connection piece defining a second housing and a second slot, said first pin engaging said first connection piece via said first housing such that said first stop pin engages said first slot, said second pin engaging said second connection piece via said second housing such that said second stop pin engages said second slot, whereby said top body is detachably mounted for movement to said plate, said top body moving from an open position to a closed position, said first recess and said second recess forming a suction chamber when said top body is in said closed position, said top body being detachable from said plate such that said top body is independently movable, said first connection piece defining a first radial access slot, said first radial access slot connecting said first housing to said first slot, said second connection piece defining a second radial access slot, said second radial access slot connecting said second housing to said second slot.

11. A device for forming a vacuum, the device comprising:

a plate or tray base forming at least a part of a suction chamber, said plate or tray base having a first lug and a second lug connected thereto, said first lug being located opposite said second lug, whereby a space is defined by said first lug, said second lug and said plate or tray base;

a top body for housing a vacuum pump, said top body forming another part of said suction chamber, said top body including a sealing bar and a control means for controlling said vacuum pump, said top body being detachably pivotably connected to said plate or tray base such that said top body moves from a raised open position to a lowered closed position, said top body and said plate or tray base forming said suction chamber when said top body is in said lowered closed position, said suction chamber being connected to said vacuum pump, said top body being removable from said plate or tray such that said top body is freely and independently movable.

12. A device according to claim 11, wherein said first lug and said second lug protrude from the rear part of said plate or tray base, said first lug and said second lug having a saddle shaped housing accessible from the top towards the bottom through a split and, concentrically to the saddle shaped housing, an arch shaped slot with a radial access slot which starts from the saddle shaped housing, said top body having two pins on opposite sides designed to lock with said saddle shaped housings of said first lug and said second lug while being removable from said saddle shaped housing and a stop pin housed through the opening in said slot enabling the body to turn and at the same time providing a constraint between the body and plate or tray base.

* * * * *